US006134751A

United States Patent [19]

Carrier et al.

[11] Patent Number: 6,134,751

[45] Date of Patent: Oct. 24, 2000

[54] ADJUSTABLE WINDOW HINGE

[76] Inventors: Germain Carrier, 124 de la Colline; Gaetan Bisson, 111 de la Colline, both of St-Lambert-de-Levis, Qc, Canada, G0S 2W0

[21] Appl. No.: 09/309,701

[22] Filed: May 11, 1999

Related U.S. Application Data

[60] Provisional application No. 60/085,063, May 12, 1998.

[51] Int. Cl.[7] ..... E05D 7/04

[52] U.S. Cl. ..... 16/242; 16/235; 16/354; 16/362; 49/336; 49/342; 49/396

[58] Field of Search ..... 16/235, 239–242, 16/362, 366, 368, 354; 403/119, 153–155; 49/336, 335, 342, 252, 396, 246

[56] References Cited

U.S. PATENT DOCUMENTS

| | | | |
|---|---|---|---|
| Re. 35,635 | 10/1997 | Bauman | 16/235 |
| 4,226,002 | 10/1980 | Davis | 16/179 |
| 5,040,267 | 8/1991 | Dallmann | 16/239 |
| 5,289,656 | 3/1994 | Vetter | 16/354 |
| 5,491,930 | 2/1996 | La See | 49/252 |
| 5,813,171 | 9/1998 | Piltingstrud | 49/359 |

FOREIGN PATENT DOCUMENTS

| | | | |
|---|---|---|---|
| 0003136 | 2/1909 | United Kingdom | 16/242 |
| 1009829 | 11/1965 | United Kingdom | 16/242 |

*Primary Examiner*—Chuck Y. Mah
*Attorney, Agent, or Firm*—Eric Fincham

[57] ABSTRACT

There is provided an adjustable window hinge suitable for casement and awning windows, the window hinge having a longitudinally extending track securable to a window frame, a shoe slidable along the track, a sash arm having one end pivotably connected to the shoe and the other end connected to the window, a support frame having a first end pivotably connected to the sash arm and a second end pivotably connected to the track, the second end being pivotably connected to the track by a rack and pinion arrangement such that rotational movement of the pinion will result in a longitudinal displacement of the stud along the longitudinally extending track.

10 Claims, 5 Drawing Sheets

ADJUSTABLE WINDOW HINGE

This application claims benefit of Provisional Appl. No. 60/085,063 filed May 12, 1998.

The present invention relates to the field of window hinges and more particularly, relates to an adjustable window hinge.

BACKGROUND OF THE INVENTION

Amongst the various types of window hinge arrangements, one typical arrangement includes a hinge member having a track mountable to the window frame and a sash arm connectable to the window sash. When such a construction is used, a support arm interconnects the track and the sash arm, with the support arm being pivotally connected to both the sash arm and to the track. Conventionally, the sash arm is pivotally connected to a shoe which is supported and guided for movement longitudinally of the track. Typically, a casement window may have a window sash movably mounted within a frame by a pair of hinges mounted between the window frame and the top and bottom of the window sash. Alternative constructions use solely one hinge member mounted between the window frame and either the top or bottom of the window sash.

One of the main drawbacks associated with casement and awning window hinges is a condition known as sash-sag. Sash-sag is the condition that occurs in casement and awning windows when the sash portion of a window is out of square with the frame. This misalignment between the window sash and the frame can be caused by faulty installation of the window unit, settling of the building, warpage caused by weathering or other conditions. Indeed, when window hinges are installed, proper operation and sealing of the window when closed requires that the fixed track pivot be properly located relative to the window sash. Even if it is properly installed, over the life of the window, the proper location of the fixed track pivot may change due to slight shifting of the window, window frame, the building itself or any other condition resulting in a sag in the sash. When sash-sag occurs, the sash and the frame of the window are no longer square to one another when the latter is in the closed position or the edge of the sash which is opposite the hinges seems to sag in comparison to the frame of the window.

The problems with sash-sag are well known. Thus, a window with sash-sag will not seal properly and will not serve its purpose of preventing the ingress of moisture and dust particularly when driven by wind. As a result, the interior environment is not as well controlled and the window is not energy efficient. Furthermore, substantial damage can occur to the window itself and particularly, when the window frame is of wood. Thus, moisture can enter and cause structural damage both to the window frame and surrounding structures.

The prior art methods of installing window hinges in a precise manner and later correction of sash-sag have usually required that the hinge track be provided with slotted holes and slotted apertures and that the hinge mounting screws in the slotted apertures be removed to allow the shifting of the track. Repeated removal of such screws can, however, cause gradual loosening of the strength of the mounting. During the setting of the frame operation, the installer may either choose to securely tighten the screws before checking the alignment with the disadvantage that subsequent adjustment requires that the screw be loosened again, which further exacerbates the potential loss of strength in the mounting or, alternatively, the installer may choose to check the alignment before securely tightening the screws, causing potential slippage of the track when the window is re-opened to allow access to the screws for tightening, with the result that the track once finally tightened might still slightly be misaligned.

It is known in the art to have adjustment devices to overcome the above problems. However, normally the prior art adjustment devices are relatively labor intensive and complex.

SUMMARY OF THE INVENTION

It is therefore an object of the present invention to provide an adjustable window hinge which is simple to adjust and provides for incremental adjustment.

It is a further object of the present invention to provide an adjustable window hinge which is simple to install and easy to use.

According to one aspect of the present invention there is provided a window hinge having a longitudinally extending track securable to a window frame, a shoe slidable along the track, a sash arm having one end thereof pivotably connected to the shoe, and a support arm having a first end pivotably connected to the sash arm and a second end pivotably connected to the track, the improvement comprising, a stud extending between the second end of the support arm and the longitudinally extending track, the second end of the support arm being pivotable about the stud, the stud being connected to the track in a rack and pinion arrangement having a rack component and a pinion component such that rotational movement of the pinion component will result in a longitudinal movement of the stud along the longitudinally extending track.

According to a further aspect of the present invention there is provided an improved window frame arrangement comprising a window frame, a window mounted within the frame and pivotably moveable between open and closed positions, and a window hinge to permit the pivotable movement between open and closed positions, the improvement comprising a window hinge having a longitudinally extending track secured to the window frame, a shoe slidable along the track, a sash arm in one end thereof pivotably connected to the shoe, a second end of the sash arm being connected to the window, a support arm having a first end pivotably connected to the sash arm and a second end pivotably connected to the track, the second end of the support arm having an aperture formed therein, a stud extending through the aperture and connected to the track in a rack and pinion arrangement having a rack component and a pinion component, the rack component being connected to the longitudinally extending track and the pinion component being connected to the stud such that rotational movement of the pinion component will result in a longitudinal movement of the stud along the longitudinally extending track.

The window hinge of the present invention may be utilized in different window arrangements including, in particular, casement and/or awning windows. The window hinge arrangement may be used to replace the conventional type of window hinge to thereby provide an adjustability thereto.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
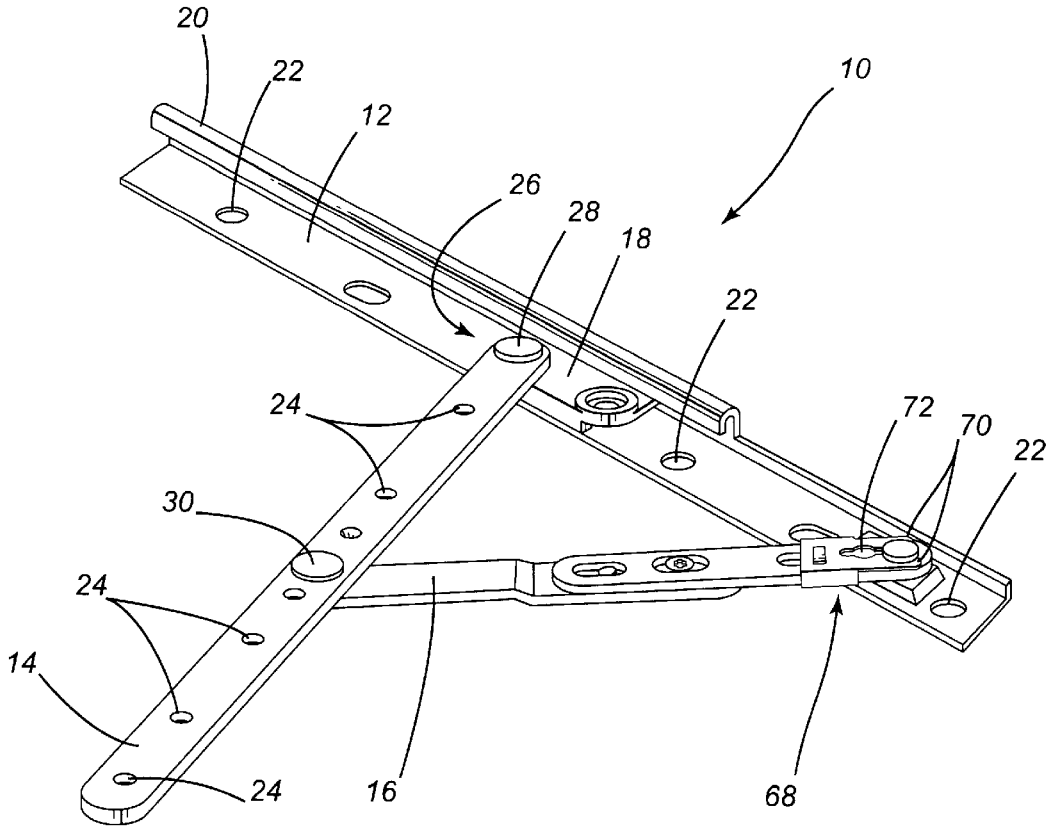
FIG. 1 is a perspective view illustrating a window hinge mechanism in accordance with a first embodiment of the present invention.

Referring to the drawings in greater detail and by reference characters thereto, there is shown in FIG. 1 a perspective view of a hinge mechanism 10 in accordance with a first embodiment of the present invention. Hinge mechanism 10 includes a track 12, a sash arm 14 and a support arm 16. A shoe member 18 is suitably secured to track 12 for longitudinal sliding movement along the latter as is well known in the art.

Track member 12 has a generally elongated configuration with a retaining lip 20 extending integrally from a peripheral edge thereof for slidably securing shoe 18. Track 12 further includes apertures 22 extending therethrough for mounting track 12 to a window frame (not shown). Apertures 22 are configured and sized so as to receive conventional fixing means such as conventional screws (not shown). In as much as the present invention does not require the track component 12 to be shifted along its longitudinal axis so as to allow for adjustment of the relative positioning with the window, apertures 22 may be given a generally circular configuration so as to securely mount track 12 against any movement with respect to the window frame.

Similarly, sash arm 14 includes a set of sash arm apertures 24 extending therethrough. Sash arm apertures 24 are adapted to be used for mounting sash arm 14 along the side of a window sash (not shown) such that hinge mechanism 10 connects the window sash to the window frame for suitable opening and closing of the window. Again, sash arm openings 24 are preferably sized and given a generally disk shaped configuration so as to prevent any relative movement between the sash arm and the window sash.

Sash arm 14 is pivotally connected adjacent one end 26 to shoe 18 by a suitable pivotable connection such as a rivet 28 or the like.

Support arm 16 is also pivotally connected at one end thereof to sash arm 16 by connecting means such as a rivet 30.

Figure 2A:
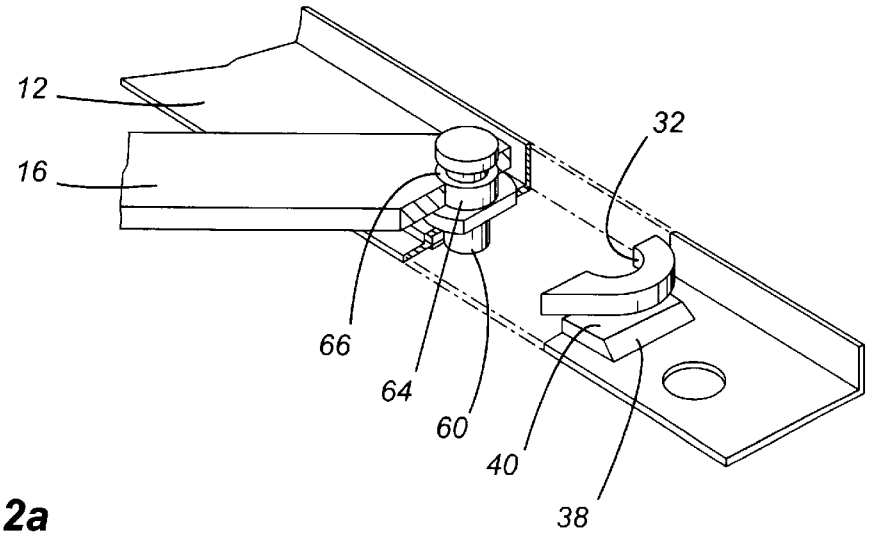
FIG. 2A is a partial perspective view, with sections taken out, illustrating the connection between components of the hinge mechanism shown in FIG. 1.
Figure 2B:
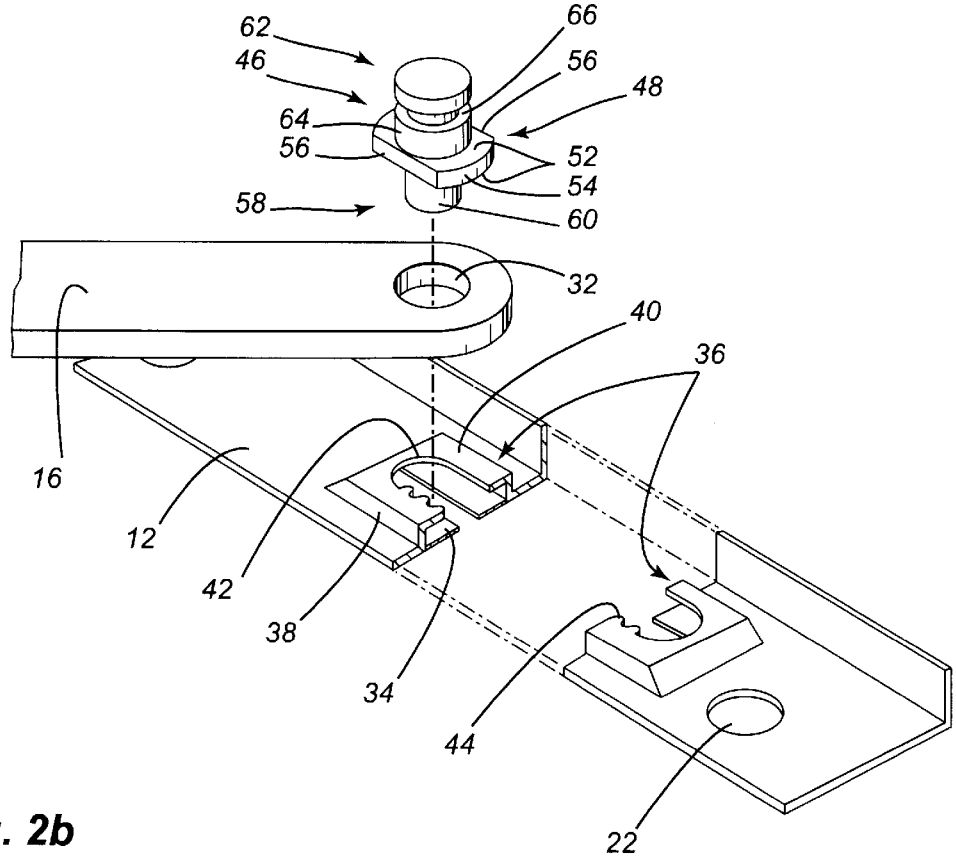
FIG. 2B is a partially exploded view illustrating the relationship between various components part of the hinge mechanism shown in FIG. 1.
Figure 3:
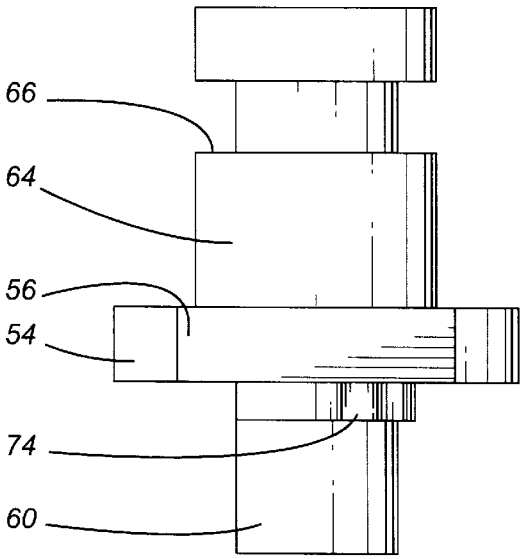
FIG. 3 is an elevational view illustrating a pin component part of the hinge mechanism shown in FIG. 1.
Figure 4:
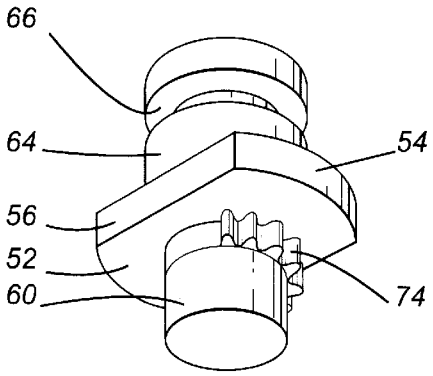
FIG. 4 is a perspective view illustrating the pin component shown in FIG. 3.
Figures 5, 6:
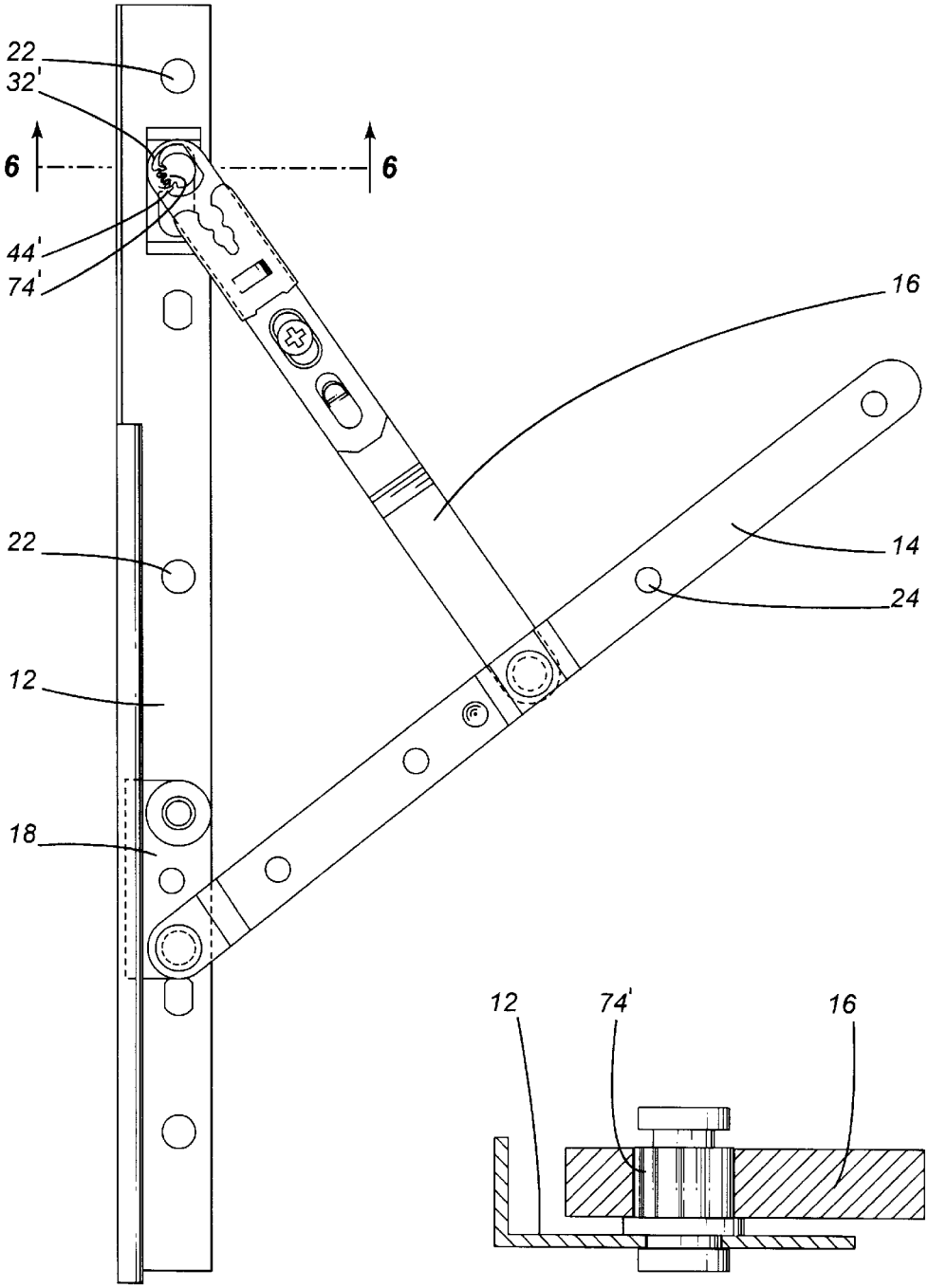
FIG. 5 is a top view illustrating a hinge mechanism in accordance with a second embodiment of the present invention.
FIG. 6 is a partial elevational view, with sections taken out, illustrating the connection between components of the hinge mechanism shown in FIG. 5.
Figure 7:
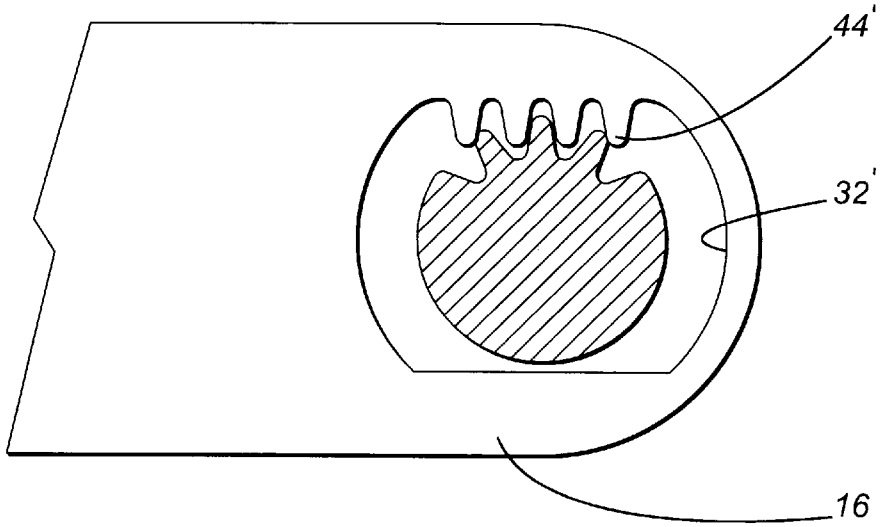
FIG. 7 is a partial top view, with sections taken out, illustrating some of the interconnective components of the hinge mechanism shown in FIG. 5.
Figure 8:
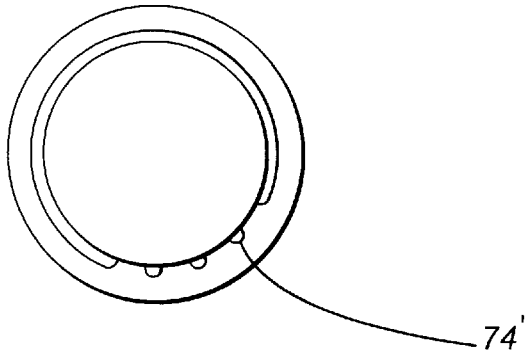
FIG. 8 is a top view illustrating part of a pin component of the hinge mechanism shown in FIG. 5.
Figure 9:
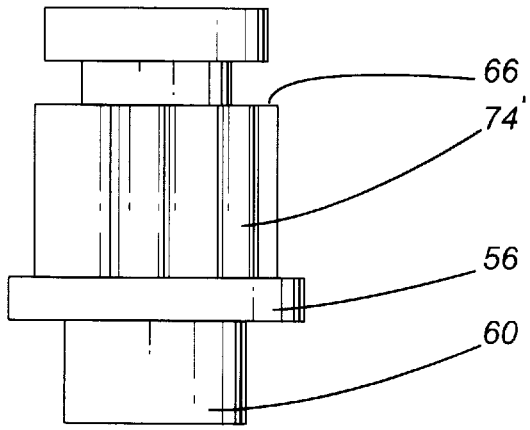
FIG. 9 is an elevational view illustrating the pin component shown partially in FIG. 8.

Referring now more specifically to FIG. 2B, there is shown, in a partial exploded view with sections taken out, the connection between the second end of support arm 16 and track 12. Second end of support arm 16 has an aperture 32 formed therein. Track 12 has a base slot 34 formed therein. A rack component 36 extends over base slot 34. Rack component 36 includes a side wall 38 extending upwardly from track 12 and a horizontal wall 40 extending substantially perpendicularly from side wall 38 in a generally parallel relationship with track 12. Horizontal wall 40 is formed with a longitudinally extending slot 42. One of the longitudinal edges of slot 42 is provided with a set of teeth 44 extending integrally therefrom.

A stud member generally designated by reference numeral 46 is adapted to be used for connecting the second end of support arm 16 to rack component 36. Stud member 46 has a flange 48 with upper and lower surfaces 50, 52 respectively and a peripheral surface 54 extending thereabout. Peripheral surface 54 includes opposite substantially flat sections 56 for reasons which will become apparent hereinbelow.

Stud 46 includes a lower cylindrical portion 60 adapted to extend through slots 42 and 34. Lower cylindrical portion 60 is adapted to form a rivet head (not shown) after assembly on track 12 so that lower surface 52 from which the tenon extends engages horizontal wall 40 and the rivet head engages the side of the track opposite rack component 36 to frictionally secure the stud against freely pivoting relative to track 12.

An upper portion 62 of stud 46 extends from upper face 50 of flange 48. Upper portion 62 includes an annular groove 66. Annular groove 66 is configured and sized so as to fittingly receive a locking mechanism such as releasable locking tongue 68. Locking tongue 68, shown more specifically in FIG. 1, is slidably mounted on support arm 16 and includes a pair of resilient fingers 70 defining an indentation 72 therebetween. Indentation 72 is adapted to be resiliently mounted around annular groove 66 so that resilient finger 70 resiliently locks around the latter. Device 68 is thus adapted to releasably lock support arm 16 on pivot portion 46 to thereby releasably lock support arm 16 to track 12.

Lower portion 60 has a set of pinion teeth 74 extending substantially radially therefrom. Pinion teeth 74 are adapted to cooperate with rack teeth 44 so as to allow selective incremental relative adjustment of the positioning of stud 46 relative to rack component 36.

As will be apparent to a person ordinarily skilled in the art, once an understanding of the present invention is obtained, adjustment of the above described hinge may be simply accomplished. Indeed, when sag is detected in the supported window sash, whether during initial installation or developing over time, it may be simply corrected by turning stud 46 so that matching teeth 44 and 74 move stud 46 relative to the longitudinal axis of track 12. This may be done by a suitable wrench sized to engage flat sections 56.

FIGS. 5 through 9 illustrate an alternative embodiment of the invention wherein the relative positioning of the teeth is changed. The second embodiment shown in FIGS. 5 through 9 is similar to that shown in FIGS. 1 through 4 and thus similar reference numerals will be used to denote similar components. The main difference between the embodiment shown in FIGS. 1 through 4 and the embodiment shown in FIGS. 5 through 9 resides in that rack teeth 44' are formed directly in a straight section of the wall defining aperture 32'. Consequently, the relative dimensioning of the stud segments is changed so as to accommodate teeth 74' for engagement with teeth 44'.

Figure 10:
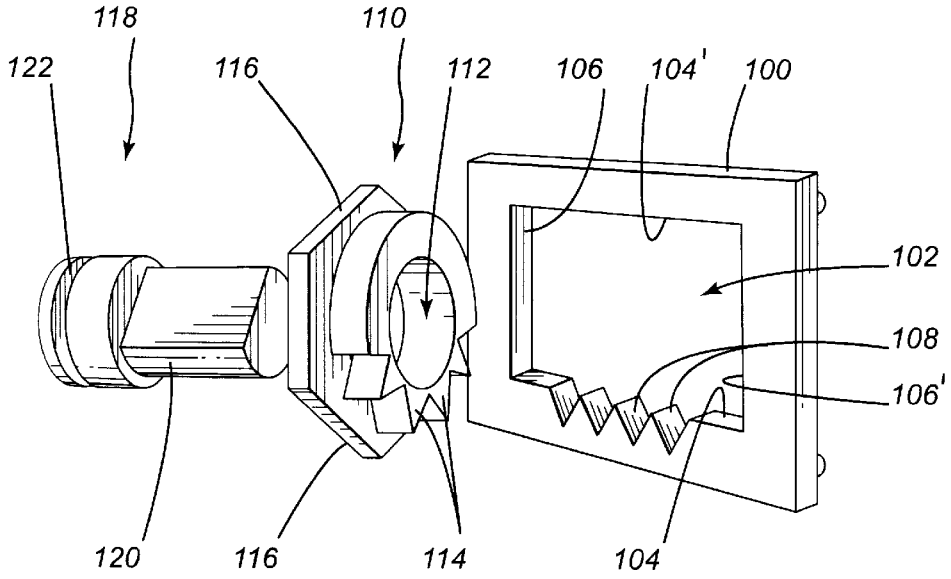
FIG. 10 is an exploded view of an alternative arrangement of a rack and pinion drive which may be utilized with the window hinge of the present invention.
Figure 11:
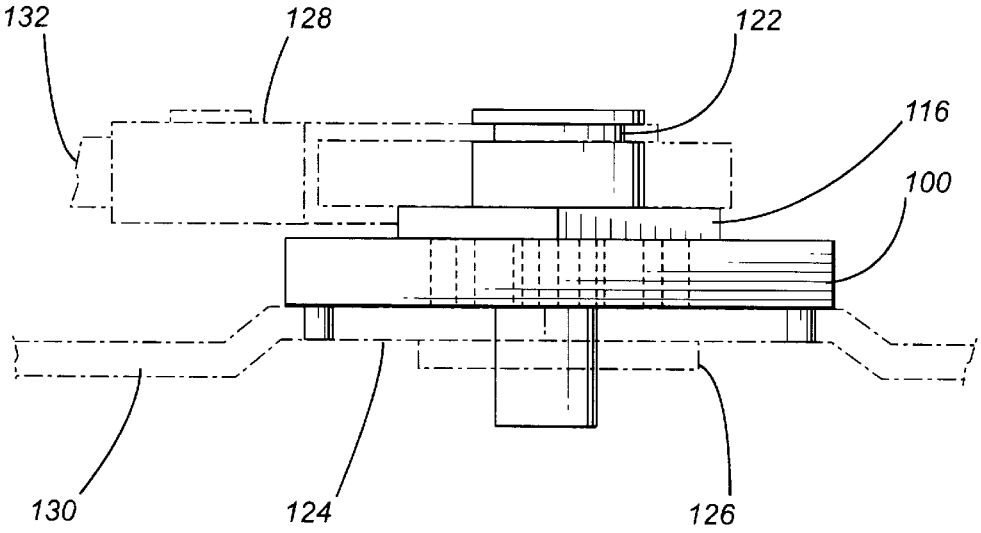
FIG. 11 is a partial side elevational view of the assembled components of the rack and pinion drive as shown in FIG. 10.

Turning to the embodiment illustrated in FIGS. 10 and 11, there is illustrated a rack component 100 having an elongated slot 102 formed therein. Slot 102 is defined by a pair of said walls 104, 104' and a pair of end walls 106, 106'. Formed on side wall 104 are a plurality of teeth 108.

A cog wheel 110 has a centrally located aperture 112 while on an exterior wall of cog wheel 110 there are provided pinion teeth 114. It will be noted that cog wheel 110 has a plurality of flat surfaces 116 to provide an overall hexagonal shape and which flat surfaces 116 may be engaged by a wrench or other suitable tool.

A stud member 118 includes a shaft 120 having an annular groove 122 formed at one end thereof.

As shown in FIG. 11, rack component 100 is mounted to a raised land portion 124 of longitudinal track 118. Cog wheel 110 is placed within slot 102 of rack component 100 with pinion teeth 114 engaging rack teeth 108. A washer 126 may be mounted on shaft 120 beneath longitudinal track 130 and shaft 120 may be flattened in a rivet type arrangement. A retaining member 128 similar to releasable locking tongue 68 in the embodiment of FIG. 1 may be mounted on sash arm 132.

It will be seen that the above arrangement provides an invisible window hinge whereby a wrench may be utilized to engage flat surfaces 116 of cog wheel 110 causing movement of the same along slot 102 within rack component 100. As shaft 120 of stud 118 fits within aperture 112 of cog wheel 110, the pivot point of connection between sash arm 122 and longitudinal track 130 may be changed.

It will be understood that the above described embodiments are for purposes of illustration only and that changes and modifications may be made thereto without departing from the spirit and scope of the invention.

We claim:

1. In a window hinge having a longitudinally extending track securable to a window frame, a shoe slidable along said track, a sash arm having one end thereof pivotably connected to said shoe, and a support arm having a first end pivotably connected to said sash arm and a second end pivotably connected to said track, the improvement comprising:

a stud extending between said second end of said support arm and said longitudinally extending track, said second end of said support arm being pivotable about said stud, said stud being connected to said track in a rack and pinion arrangement having a rack component and a pinion component such that rotational movement of said pinion component will result in a longitudinal movement of said stud along said longitudinally extending track.

2. The improvement of claim 1 further including retaining means for retaining said second end of said support arm on said stud.

3. The improvement of claim 2 wherein said stud has an annular groove proximate an upper end thereof, said retaining means comprising a clip slidable along said arm and being removably engageable with said groove.

4. The improvement of claim 1 wherein said track has an elongated slot formed therein, at least one wall about said elongated slot extending in the longitudinal direction of said track, said at least one wall having rack teeth formed thereon to thereby form the rack component of said rack and pinion arrangement, and a cog wheel mounted on said stud, said cog wheel forming said pinion component and having pinion teeth engageable with said rack teeth on said at least one wall.

5. The improvement of claim 4 wherein said cog wheel has outwardly facing flat wall surfaces engageable by a wrench.

6. The improvement of claim 1 wherein said rack and pinion arrangement comprises a rack member mounted on said longitudinally extending track, said rack member having rack teeth formed on a longitudinally extending wall thereof, and a cog wheel mounted about said stud, said cog wheel having pinion teeth engaged with said rack teeth, the arrangement being such that rotational movement of said cog wheel will cause said cog wheel to move longitudinally along said rack and thereby cause like longitudinal movement of said stud.

7. The improvement of claim 1 wherein said second end of said support arm has an aperture therein, said stud extending through said aperture, said aperture having a straight wall section extending about a portion of said aperture, teeth being formed on said straight wall section to thereby form said rack component, said stud having pinion teeth formed thereon engageable with said rack teeth.

8. An improved window frame arrangement comprising a window frame, a window mounted within said frame and pivotably moveable between open and closed positions, and a window hinge to permit pivotable movement between said open and closed positions, said window hinge having a longitudinally extending track secured to said window frame, a shoe slidable along said track, a sash arm in one end thereof pivotably connected to said shoe, a second end of said sash arm being connected to said window, a support arm having a first end pivotably connected to said sash arm and a second end pivotably connected to said track, said second end of said support arm having an aperture formed therein, a stud extending through said aperture and connected to said track in a rack and pinion arrangement having a rack component and a pinion component, said rack component being connected to said longitudinally extending track and said pinion component being connected to said stud such that rotational movement of said pinion component will result in a longitudinal movement of said stud along said longitudinally extending track.

9. The arrangement of claim 8 wherein said track has an elongated slot formed therein, at least one wall about said elongated slot extending in the longitudinal direction of said track, said at least one wall having teeth formed thereon to thereby form the rack portion of said rack and pinion arrangement, and a cog wheel mounted on said stud, said cog wheel having teeth engageable with said teeth on said at least one wall.

10. The arrangement of claim 8 wherein said rack and pinion arrangement comprises a rack member mounted on said longitudinally extending frame, said rack member having teeth formed on a longitudinally extending wall of a slot formed therein, and a cog wheel mounted about said stud, said cog wheel having teeth engaged with said teeth on said rack, the arrangement being such that rotational movement of said cog wheel will cause said cog wheel to move longitudinally along said rack and cause longitudinal movement of said stud.

* * * * *